United States Patent [19]

Hasegawa

[11] Patent Number: 4,522,197

[45] Date of Patent: Jun. 11, 1985

[54] GLOVES FOR RECOVERING THE FUNCTIONS OF THE CARPAL JOINT, THE HAND AND THE FINGERS

[75] Inventor: Tsuneo Hasegawa, Tokyo, Japan

[73] Assignee: Man Design Co., Ltd., Tokyo, Japan

[21] Appl. No.: 522,232

[22] Filed: Aug. 11, 1983

[30] Foreign Application Priority Data

Aug. 11, 1982 [JP] Japan ..... 57-138467
Jun. 10, 1983 [JP] Japan ..... 58-102717

[51] Int. Cl.[3] ..... A61H 1/02

[52] U.S. Cl. ..... 128/26; 128/DIG. 20; 84/465

[58] Field of Search ..... 128/25 R, 26, DIG. 20; 272/67; 84/465; 2/160, 161 A, 163, DIG. 3

[56] References Cited

U.S. PATENT DOCUMENTS

| | | | |
|---|---|---|---|
| 1,174,205 | 3/1916 | Underwood | 84/465 |
| 3,457,912 | 7/1969 | Clark et al. | 128/26 |
| 3,937,215 | 2/1976 | Barthlome | 128/26 |
| 4,274,399 | 6/1981 | Mummert | 128/26 |

FOREIGN PATENT DOCUMENTS

| | | | |
|---|---|---|---|
| 735700 | 6/1966 | Canada | 128/DIG. 20 |

*Primary Examiner*—Richard J. Apley
*Assistant Examiner*—David J. Brown
*Attorney, Agent, or Firm*—Birch, Stewart, Kolasch & Birch

[57] ABSTRACT

Web-like triangular sacs are disposed between the finger stalls of a glove-shaped body to fan the respective fingers by feeding compressed air into the sacs. A plurality of sacs are arranged on the palm portion of the body, each running from the relative stall toward and along an arm portion. When compressed air is fed into the latter-mentioned sacs, the hand and the carpal joint are extended. Charging or discharging of compressed air into or out of the sacs may be carried out simultaneously or selectively with a given cycle. By repetition of the cycle, rhythmical intermittent movement, such as fanning and extension, of the functionally disordered carpal joint, hand and fingers takes place passively for the remedy of flexion contraction and extension disturbance, and a primary factor which can induce active movement is produced.

13 Claims, 8 Drawing Figures

GLOVES FOR RECOVERING THE FUNCTIONS OF THE CARPAL JOINT, THE HAND AND THE FINGERS

BACKGROUND OF THE INVENTION

1. Field of the Invention

The present invention relates to a glove for recovering the functions of the carpal joint, the hand and the fingers which are functionally disordered incidentally by diseases and disorders of the central nervous system such as cerebral vascular diseases, cerebral injury, cerebral palsy and spinal injuries as well as peripheral nerve, articular, muscular and tendinous lesions.

2. Description of Background Information

When the upper extremity, the carpal joint, the hand and the fingers are functionally impaired by diseases and disorders of the central nervous system such as cerebral vascular diseases, cerebral injuries, cerebral palsy and spinal injuries as well as peripheral nerve, articular, muscular and tendinous lesions, it is required to recover the motor function by training, keeping pace with treament. However, it is historically believed that the recovery of the functional disorders of the carpal joint, the hand and the fingers is difficult. Many studies are being made regarding the latest rehabilitation methods. Nonetheless, virtually nothing has been elucidated with regard to this problem. For example, there is an effort to extend the carpal joint, the hand and the fingers functionally impaired by flexion contraction or extension disturbance by the action of air pressure or springs. However, satisfactory results are not obtained by this method.

It has been discovered that, with conventional remedial gloves, it is impossible to sufficiently extend the carpal joint, the hand and the fingers to provide a primary factor which can induce any active movement, since the action of air pressure and the resiliency of springs are insufficient.

SUMMARY OF THE INVENTION

A main object of the present invention is therefore to apply air pressure reasonably, intermittently or continuously and properly to the carpal joint, the hand and the fingers to effect positive fanning of the respective fingers and positive extension of the carpal joint, the hand and fingers for recovering the extension disturbance thereof, whereby the functional plasticity and compensatory function of the nervous system are promoted to give rise to a primary factor which can induce the active movement of the carpal joint, the hand and the fingers.

BRIEF DESCRIPTION OF THE DRAWINGS

For a better understanding of the present invention, two embodiments of the present invention will now be explained with reference to the drawings, in which.

DETAILED DESCRIPTION OF THE INVENTION

Figure 1:
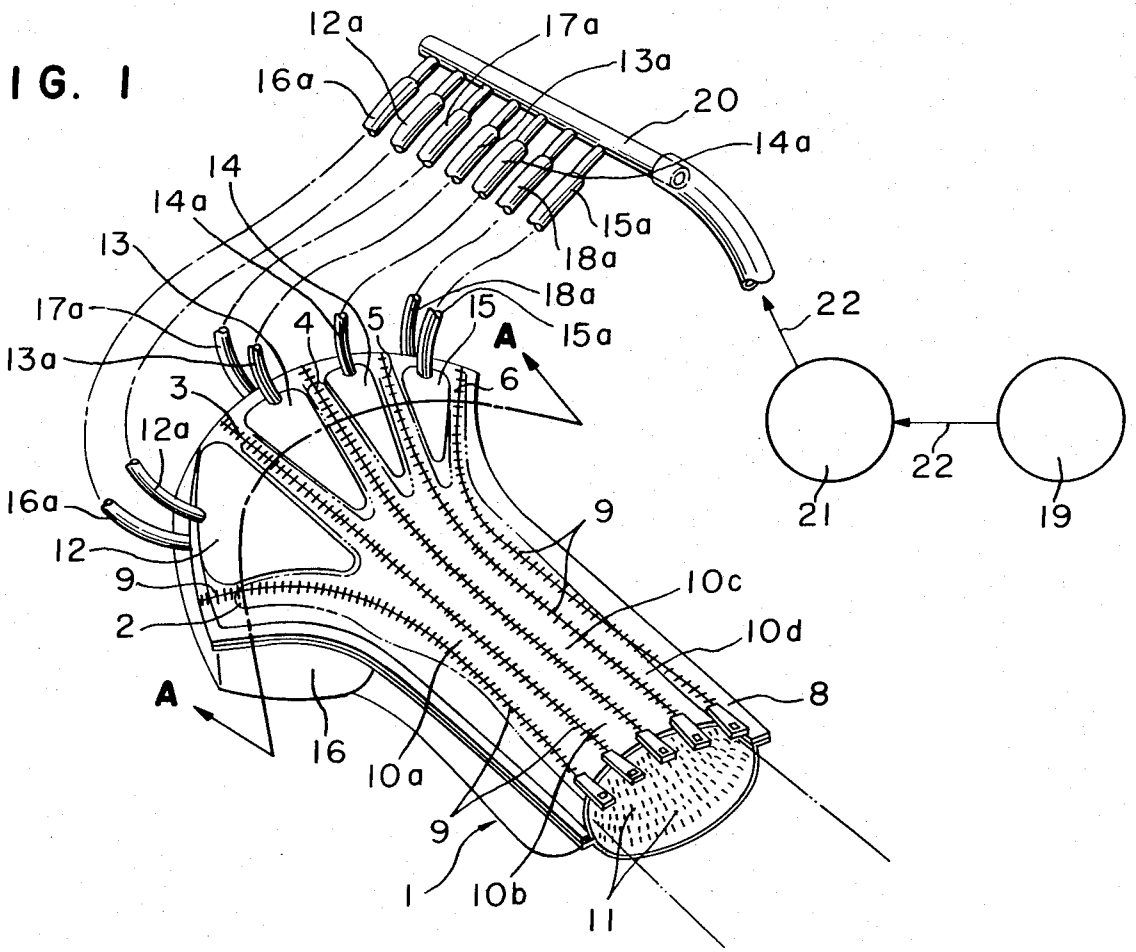
FIG. 1 is a perspective view showing the glove according to the first embodiment of the present invention in use.

Referring to FIGS. 1 to 4, a glove-shaped body shown generally at 1 is designed to simultaneously enclose the palm and back of the hand as well as the forearm including the carpal joint upon closing the glove-shaped body in the manner as will be described later. The body 1 comprises three portions, a fingerstall portion divided into five stalls 2, 3, 4, 5 and 6 adapted to separately receive the five fingers, a main portion 7 adapted to cover the palm and back of the hand, and an arm portion 8 adapted to cover an area from the carpal joint and extending along the arm.

Five fasteners 9 are provided for separately opening back members 10*a*, 10*b*, 10*c* and 10*d*, each running from the opening located on the forearm side of the body 1 to the relative stall. Numerous protrusions are provided on the entire inner face of the body 1 with a view to preventing slipping of the palm.

A sac 12 is interposed between the stalls 2 and 3 for the thumb and the index fingers. A sac 13 is interposed between the stalls 3 and 4 for the index and middle fingers. A sac 14 is interposed between the stalls 4 and 5 for the middle and medical fingers. Similarly, a sac 15 is interposed between the stalls 5 and 6 for the medical and little fingers. As depicted in FIG. 1, the sacs 12 to 15 are each in the triangular form as generally exemplified by a web with the sac 12 being the largest sac relative to the remaining sacs 13–15. Charge/discharge tubes 12*a*, 13*a*, 14*a* and 15*a* are provided for charging or discharging compressed air into or out of the associated sacs 12, 13, 14 and 15.

Figure 2:
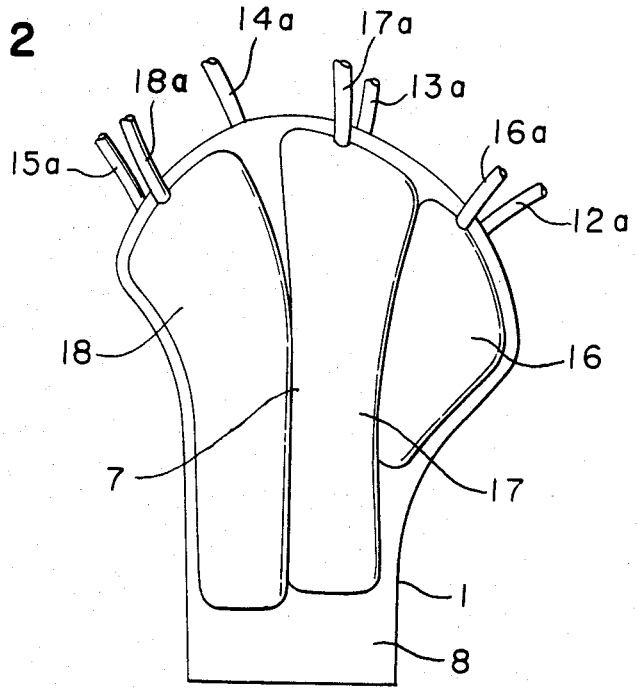
FIG. 2 is a plan view of that glove, as viewed from the palm side thereof.
Figure 3:
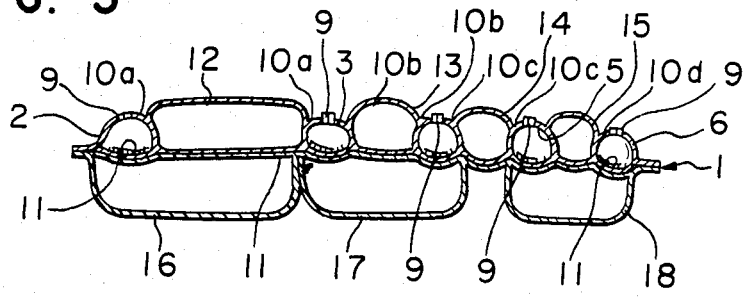
FIG. 3 is a sectional view showing the fingers stalls, taken along the line A—A of FIG. 1.

Sacs 16, 17 and 18 are arranged on the palm side of the body 1 along its lengthwise direction, and come into contact with each other, as illustrated in FIG. 2. Among these sacs, part of the sac 16 covers the palm side of the thumb stall 2, while another part thereof comes into close contact with the underside of the sac 12, and somewhat projects toward the thumb stall 2 and outwardly of the body 1. Part of the sac 17 covers the palm side of the stalls 3 and 4 for the index and middle fingers, while another part thereof comes substantially into close contact with the underside of the sac 17, the palm side of half of the body 1, wherein the thumb 6 is located, and the inner side of the arm portion 8 on the same side. Furthermore, part of the sac 18 covers the palm sides of the stalls for the medical and little fingers, while another part thereof comes substantially into close contact with the underside of the sac 18, the palm side of half of the body 1, wherein the little finger is located, and the inner side of the arm portion 18 on the same side. Charge/discharge tubes 16*a*, 17*a* and 18*a* are provided for feeding or discharging compressed air into or out of the associated sacs 16, 17 and 18.

In FIG. 1, a compressed air supply source 19, such as a compressor, is provided for feeding compressed air having low pressure into a manifold or distributor 20 which distributes the compressed air to the sacs 12 to 18 of the body 1. The supply source 19 is connected with the distributor 20 through a supply pipe 22 and an electromagnetic changeover valve 21 disposed midway therethrough.

Figure 4:
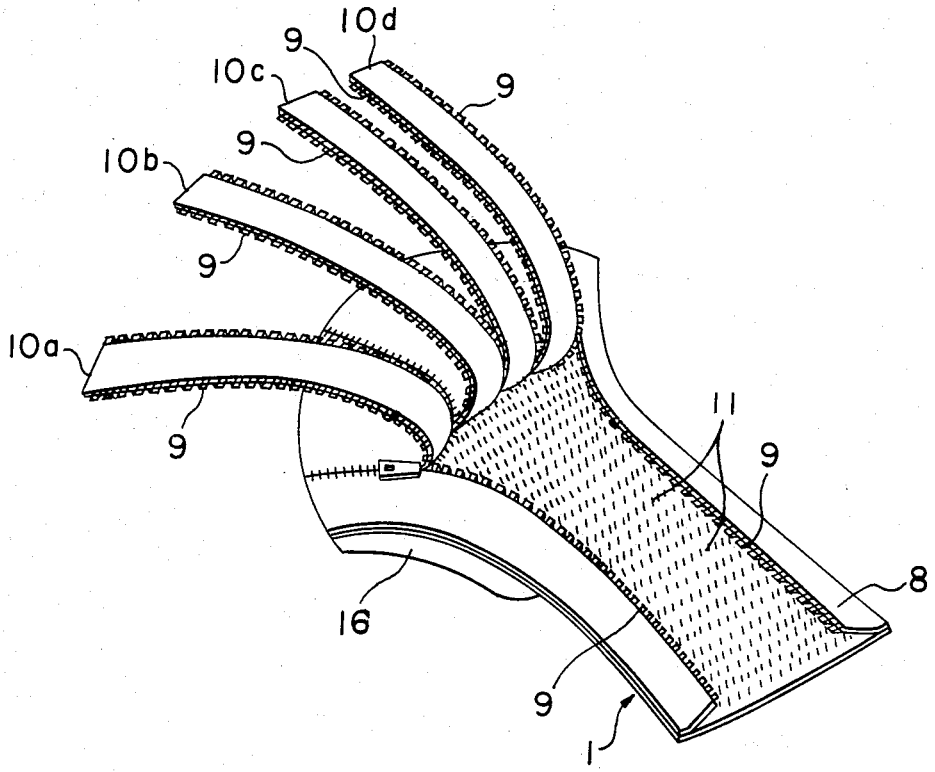
FIG. 4 is a perspective view showing the glove according to the first embodiment, which is shown to have its back members tucked up.
Figure 5:
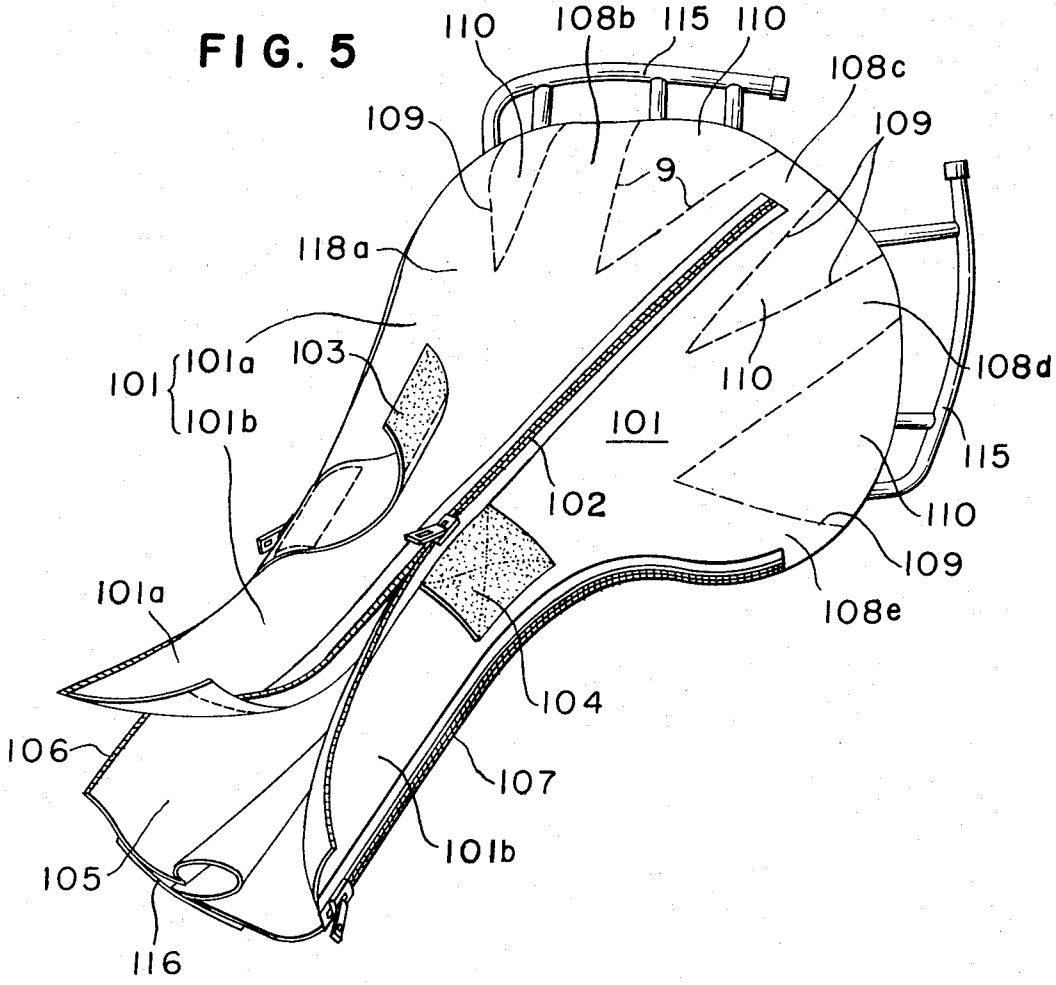
FIG. 5 is a perspective view of the glove according to the second embodiment of the present invention, as viewed from the back side thereof.

The foregoing embodiment of the present invention is used as follows. All the fasteners 9 are unzipped to open the back members 10*a*, 10*b*, 10*c* and 10*d* until the finger-inserting openings of the stalls 2 to 6 are nearly exposed to view, as illustrated in FIG. 4. Thereafter, the hand of a patient is held along the body 1, and the five fingers are separately inserted into the stalls 2, 3, 4, 5 and 6. For example, the fingers may be inserted in the order of the thumb, the index finger, the middle finger, the medical finger and then the little finger. Subsequently, the five fasteners are successively zipped up to assume the gloved-shaped form, so that the fingers, the palm and back of the hand and the forearm including the carpal joint are enclosed in the glove.

Driving of the air supply source 19 in this state causes low-pressure air to enter the distributor 20 through the supply pipe 22, wherefrom the air is distributed to the seven tubes and enters the sacs 12 to 15 and the sacs 16 to 18 through the associated charge/discharge tubes 12*a* to 15*a* and the associated charge/discharge tubes 16*a* to 18*a*, thereby to expand the sacs 12 to 18. As a result, the body 1, which is contracted and collapsed at the outset, expands in response to the expansion of the sacs 12 to 18 to extend the carpal joint and the hand functionally impaired by flexion contraction or extension disturbance simultaneously with fanning and extension of the fingers. In this manner, the extension of the carpal joint as well as the extension and fanning of the hand and the fingers are effected passively.

Charging or discharging of compressed air is done by electrical actuation of the electromagnetic changeover valve 21 disposed midway through the supply pipe 22. When the valve 21 is changed over to "supply", feeding of compressed air into the sacs 12 to 18 takes place, and when it is changed over to "discharge", the air within the sacs 12 to 18 is released in the atmosphere simultaneously. By repetition of the expansion and contraction of the sacs 12 to 18 to a given rhythm, the above-mentioned extension and fanning of the carpal joint, the hand and the fingers can be effected rhythmically and intermittently. Separate or simultaneous expansion and contraction of the sacs 12 to 18 allow the required region or regions to be extended and fanned for the recovery of flexion contraction and extension disturbance, which gives rise to a recovery factor to induce active movement.

It is noted that, when flexion contraction and extension disturbance are not found over the carpal joint, the hand and the fingers, it is possible to recover the required region or regions by closing up the charge/discharge tubes leading to the unnecessary sacs by suitable means such as clips, or alternatively removing the tubes from the distributor 20, and closing up the remaining openings by suitable means such as caps.

Since the first embodiment of the present invention as mentioned above is designed such that the back members 10*a*, 10*b*, 10*c* and 10*d* can freely be opened and closed with the use of the fasteners 9, it is easy to insert and hold in the glove even a hand whose fingers are markedly crooked. Therefore, the glove according to the first embodiment of the present invention can easily be used and removed after use regardless of the degree of flexion contraction of the carpal joint, the hand and the fingers.

Referring to FIGS. 5 to 8 inclusive, a mitten-shaped body shown generally at 101 is designed to simultaneously enclose the palm and back of the hand and the forearm including the carpal joint, and comprises a combination of flexible blanks, one forming a palm portion and the other a back portion. The back portion-forming blank comprises left and right fabrics 101*a* and 101*b* which are commensurate with a wide region from the fingers to the forearm to the carpal joint on the back side, and joined to the palm portion-forming blank 105 as mentioned below. Left and right fabrics 101*a* and 101*b* forming the back portion include a slide fastener 102 which is openable in its lengthwise direction. One fabric 101*a* partitioned by the fastener 102 is provided with hooks 103 of a velvet fastener, and the other fabric 101*b* is formed with loops 104 of the velvet fastener which are designed to be releasably secured relative to each other.

Furthermore, two slide fasteners 106 and 107 are arranged on both sides of the back and palm portion-forming blanks. By opening all of the three slide fasteners 102, 106 and 107 the palm portion-forming blanks 101*a* and 101*b* can be tucked up to the fingertips.

Finger stalls 108*a* to 108*e* are formed by sewing together or otherwise joining together, partitions 109 of the body 101 for separate insertion of the five fingers. Between the respective finger stalls, there are defined by the partitions 109 triangular fourchette-like sacs 110 which can all be filled with compressed air at one time.

Figure 6:
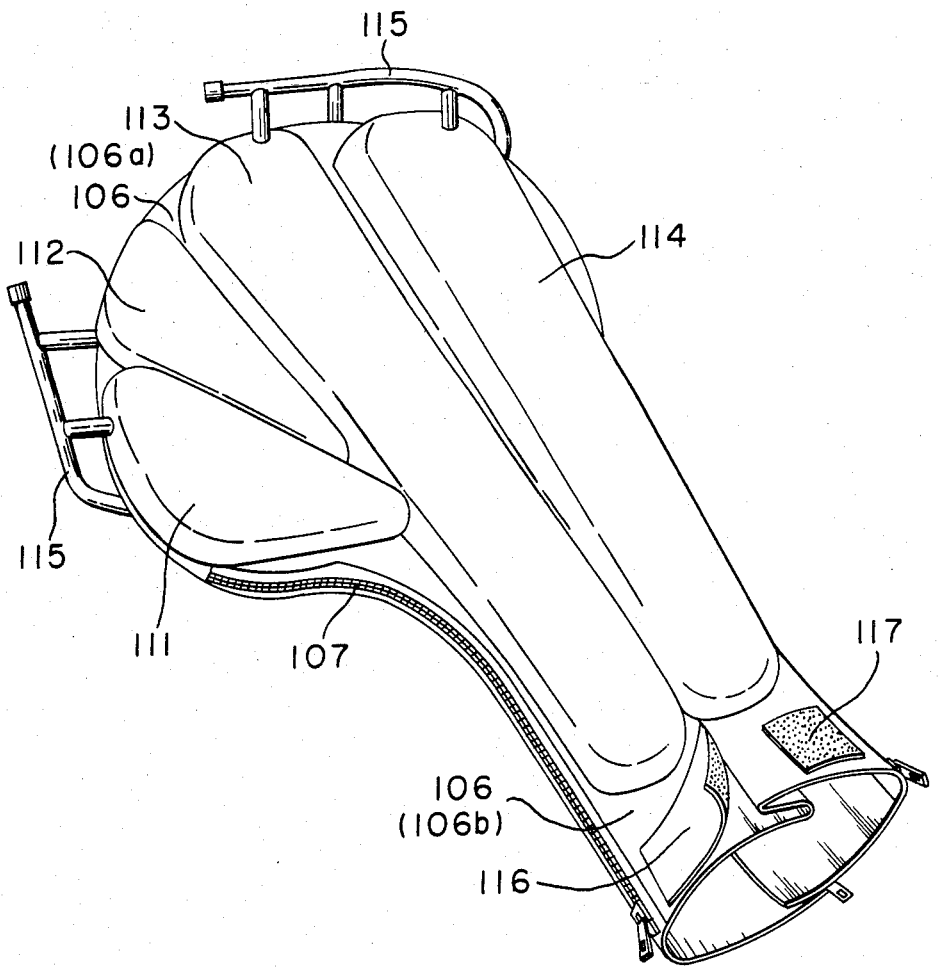
FIG. 6 is a perspective view of the glove of FIG. 5, as viewed from the palm side thereof.
Figure 7:
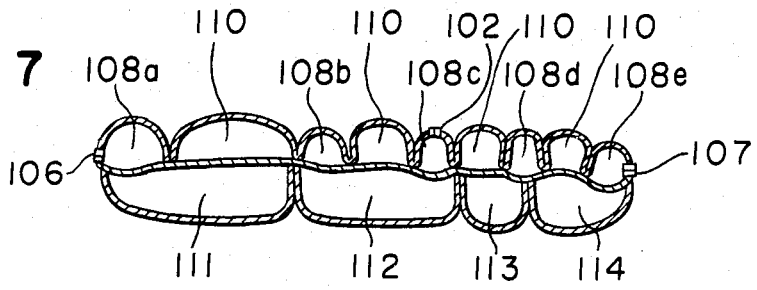
FIG. 7 is a cross-sectional view of the finger stalls of the glove of FIG. 5.

As best seen from FIG. 6, sacs 111, 112, 113 and 114 are arranged on the outer face of the palm portion-forming blank of the body. The sac 111 is commensurate with the back of the thumb stall. The sac 112 is commensurate with a region between the thumb and the index finger and the index finger stall. The sac 113 covers the middle finger stall and extends therefrom substantially over the full length of the body 101. Finally, the sac 114 covers the medical and little fingers and extends therefrom substantially over the full length of the body 101. It is understood that no particular limitation is imposed upon the number, size and shape of the sacs 111 to 114. For instance, one or three or more of sacs 113 or 114 may be used.

A manifold or distributor 115 is provided to feed or discharge compressed air into or out of all of the respective sacs 110 and 111 to 114. Hooks 116 of a velvet fastener are provided on the outer face of the arm portion and loops 117 of the velvet fastener are provided for releasable engaging the hooks 116.

In using the second embodiment, the slide fastener 102 on the middle of the back portion of the body 101 and the slide fasteners 106, 107 on both sides of the body 101 are unzipped, whereby the back fabrics 101*a* and 101*b* are tucked up to the finger-tips, thus exposing to view substantially the entire range of the innerface of the palm portion. The functionally disordered palm is then placed on the inner face of the palm portion with the fingers being held on the relative finger stalls 108*a*–108*e*.

After all or part of the fingers are placed on all or part of the finger stalls 108*a* to 108*e*, the slide fastener 102 and the slide fasteners 106, 107 are zipped up to enclose the hand in the body 101.

After the hand and the fingers are held in place within the body 101 in this manner, the velvet fasteners 103 and 104 provided on the outer face of the back portion are engaged with each other under proper tension, thereby to cover the arm. Finally, the velvet fasteners 116 and 117 provided on the palm portion are engaged with each other in the same manner.

Figure 8:
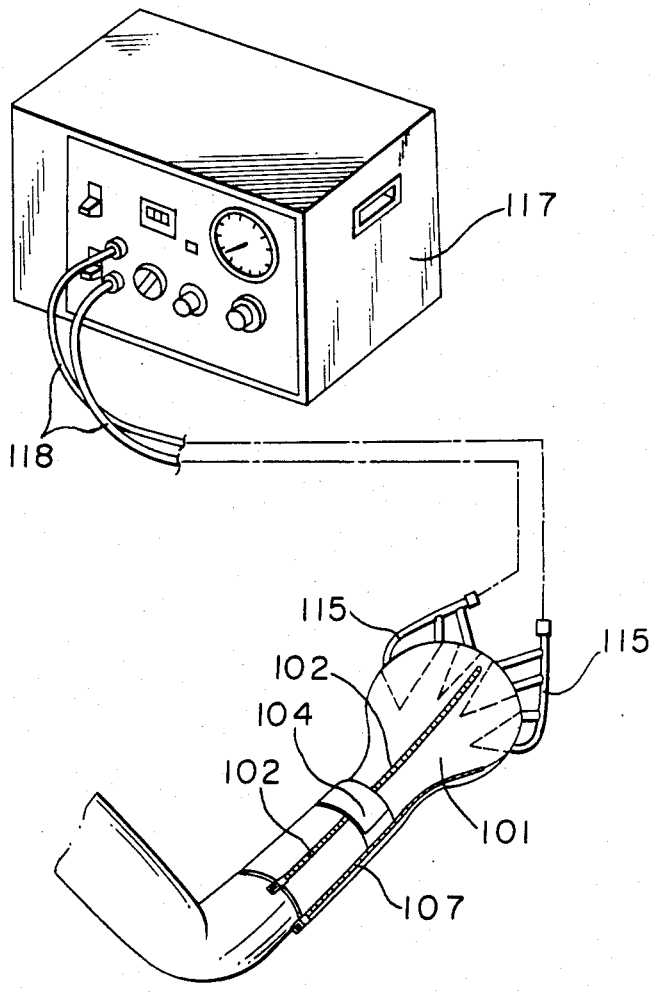
FIG. 8 is a perspective view showing the glove according to the second embodiment in use.

After the fingers and the arm are enclosed in the glove according to the present invention in this manner, the glove is connected with compressed air supply pipes 118, 118, as shown in FIG. 8, which are joined to a compressed air supply source 117 including a compressor and various controls. Thereupon, compressed air is introduced into the sacs 110 to 114 all at once. When the compressed air is admitted into the sacs 110 between the respective fingers and the sacs 111 to 114, all the sacs are simultaneously expanded, so that the respective fingers held in the respective finger stalls 108*a* to 108*e* are fanned all at once by the thus expanded sacs 110 and, at the same time, the palm is forced open by the thus expanded sacs 111 to 114. In addition, the enclosed hand and the wrist are bent toward the back of the hand and extended. After extension is continued for the required time, the compressed air is removed from the sacs so that the glove returns to its original state. Thereupon, the compressed air is re-charged in the sacs. Thus, the carpal joint and the fingers are passively fanned and extended by repeated charging and discharging of compressed air.

As mentioned above, rhythmical and intermittent stimuli are simultaneously given to the functionally disordered carpal joint, hand and fingers by passively extending and fanning them by means of the glove of the present invention. Therefore, when stimuli are given to the carpal joint, the hand, and the fingers by this glove, they are transmitted to the sensoriperceptual system of the central nerve through the sensory nerve and, then, to the motor system through the nerve fibers in the central nervous system. Thereby, the plasticity and compensatory function of the nervous system are induced and promoted, so that active movement of these regions takes place and is promoted for the recovery of function.

In addition, the glove of the present invention can sufficiently effect positive fanning of the fingers simultaneously with extension of the fingers, the hand and the carpal joint, in comparison with the conventional remedial gloves which rely only upon air pressure or springs. Therefore, good results are obtained with respect to the recovery of function. Rhythmical or intermittent changes in air pressure also ensure reasonably and properly that passive movement of the fingers, the hand and the carpal joint are effected intermittently or continuously. Furthermore, it is possible to effect isolated passive movement suitable for the function of the carpal joint.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A glove for the recovery of the functions of the carpal joint, the hand and the fingers of an individual, comprising in combination:

a glove-shaped body including stall portions adapted to separately receive an individual's fingers, a main portion adapted to cover the palm and back of an individual's hand, and an arm portion adapted to cover the forearm including the carpal joint;

a plurality of fanning sacs interposed between the respective stall portions for effecting fanning of the respective fingers;

a plurality of extension sacs arranged on the palm portion for effecting extension of the fingers, the hand and the carpal joint, said extension sacs extending from said stall portions toward and along said arm portion; and a plurality of compressed air charge/discharge tubes connected to all of said fanning and extension sacs, for supplying compressed air simultaneously or selectively into all of said fanning and extension sacs or specific fanning and extension sacs through said tubes, and for discharging the compressed air after the lapse of a predetermined time;

whereby repeated charging and discharging of compressed air passively effect rhythmical and intermittent movement, such as fanning and extension, of the functionally disordered carpal joint, hand and fingers for the recovery of flexion contraction and extension disorder, and gives rise to a primary factor which can induce active movement.

2. The glove according to claim 1, in which said fanning sacs of the respective fingers are triangular web shaped members.

3. The glove according to claim 1, wherein said glove-shaped body is formed of a flexible material.

4. The glove according to claim 1, wherein the coverings of said fanning sacs for fanning of the fingers are formed of a flexible material.

5. A glove according to claim 1, wherein said extension sacs for extension of the fingers, the hand and the carpal joint extend toward and along said arm portion.

6. The glove according to claim 1, wherein said stall portions are openable or closeable by slid fasteners.

7. The glove according to claim 1, wherein said charge/discharge tubes are separately connected to said fanning and extension sacs for fanning of the fingers and for extension of the fingers, the hand and the carpal joint so as to simultaneously charge or discharge compressed air into or out of said fanning and extension sacs.

8. The glove according to claim 1, wherein said charge/discharge tubes are separately connected to said fanning and extension sacs for fanning of the fingers and for extension of the fingers, the hand and the carpal joint through a valve so as to selectively charge compressed air into said fanning and extension sacs, and simultaneously discharge it from said fanning and extension sacs.

9. The glove according to claim 1, wherein said body is provided on the inner face with means for preventing slipping.

10. A glove for the recovery of the function of the carpal joint, the hand and the fingers of an individual, comprising in combination:

a mitten-shaped body including palm and back forming blanks forming finger stalls with partitions being provided between the respective finger stalls;

web-like triangular sacs being positioned between the respective finger stalls;

charge/discharge tubes provided to said sacs so as to charge or discharge compressed air into or out of all of said sacs at one time; and slide fasteners arranged on both sides of said body and on the middle of said palm portion-forming blank so as to permit opening and closing thereof;

said charge/discharge tubes being designed such that compressed air is charged simultaneously or selectively into all of said sacs or specific sacs through said tubes and is discharged therefrom after the lapse of a predetermined time;

whereby repeated charging and discharging of compressed air passively effect rhythmical and intermittent movement, such as fanning and extension, of the functionally disordered carpal joint, hand and fingers for the remedy of flexion contraction and extension disturbance, and gives rise to a primary factor which can induce active movement.

11. A method of treatment for the recovery of the functions of the carpal joint, the hand and the fingers of an individual, comprising the following steps:

positioning an individual's hand, fingers and carpal joint in a glove-shaped body including stall portions adapted to separately receive the fingers, a main portion adapted to cover the palm and back of the hand and an arm portion adapted to cover the forearm including the carpal joint, the glove-shaped body further including a plurality of fanning sacs interposed between the respective stall portions and a plurality of extension sacs arranged on the palm portion extending from the stall portions toward and along the arm portion;

supplying pressurized fluid into predetermined fanning sacs for fanning respective fingers;

supplying pressurized fluid into predetermined extension sacs for imparting movement to the hand about the carpal joint;

discharging pressurized fluid from said predetermined fanning sacs for returning the fingers to an original position;

discharging pressurized fluid from said predetermined extension sacs for returning the hand to an original position;

repeating the charging and discharging steps for effecting rhythmical and intermittent movement, such as fanning and extension, of the functionally disordered carpal joint, hand and fingers for the recovery of flexion contraction and extension disorder, for giving rise to a primary factor which can induce active movement.

12. A method according to claim 11, wherein pressurized fluid is simultaneously supplied to all of said fanning sacs.

13. A method according to claim 11, wherein pressurized fluid is simultaneously supplied to all of said extension sacs.

* * * * *